US010066336B2

(12) United States Patent
Schurr

(10) Patent No.: US 10,066,336 B2
(45) Date of Patent: Sep. 4, 2018

(54) CLOTHES DRYER WITH A DRUM SEAL

(71) Applicant: WHIRLPOOL CORPORATION, Benton Harbor, MI (US)

(72) Inventor: Daniel A. Schurr, Wyoming, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/411,089

(22) Filed: Jan. 20, 2017

(65) Prior Publication Data

US 2017/0130388 A1 May 11, 2017

Related U.S. Application Data

(63) Continuation of application No. 14/821,842, filed on Aug. 10, 2015, now Pat. No. 9,580,856.

(51) Int. Cl.
*D06F 58/04* (2006.01)

(52) U.S. Cl.
CPC ..... *D06F 58/04* (2013.01)

(58) Field of Classification Search
CPC .. F26B 25/00; F26B 11/02; F16J 15/16; F16J 15/10; D06F 58/09
USPC ..... 34/595–610; 68/5 R, 20; 277/652
See application file for complete search history.

(56) References Cited

U.S. PATENT DOCUMENTS 2,970,717 A 2/1961 Walker
3,089,327 A 5/1963 Stilwell, Jr.
3,270,529 A 9/1966 Engel
3,385,085 A 5/1968 Engel
3,409,997 A 11/1968 Cobb et al.
3,570,138 A * 3/1971 Douglas et al. ..... D06F 58/02 34/601
3,637,224 A 1/1972 Triplett et al.
3,816,942 A 6/1974 Smith
3,828,445 A 8/1974 Smoot
3,875,686 A 4/1975 Smoot
4,346,816 A 8/1982 Caille
4,430,809 A 2/1984 William et al.
4,669,200 A 6/1987 Carr
5,062,219 A * 11/1991 Harris ..... D06F 58/02 34/242
5,127,169 A * 7/1992 Ellingson ..... D06F 58/04 34/601
5,216,823 A 6/1993 Ripley
5,363,569 A 11/1994 Kadakia
5,509,669 A * 4/1996 Wolfe ..... F01D 11/005 277/654
5,548,908 A 8/1996 Torborg et al.
5,979,195 A 11/1999 Bestell et al.
(Continued)

FOREIGN PATENT DOCUMENTS

EP 2385167 A1 11/2011
EP 3130701 A1 * 2/2017 ..... D06F 58/04
(Continued)

*Primary Examiner* — Stephen M Gravini

(57) ABSTRACT

An apparatus for sealing the drum of a clothes dryer comprising an attachment with a recess sized to receive the lip of a dryer drum to mount the seal about the lip and a seal element abutting a corresponding front or rear bulkhead wherein the length of the seal is such that when in place there remains an intervening gap in which a spacer capable of changing shape is located allowing the seal to expand and contract with thermal variations.

24 Claims, 6 Drawing Sheets

(56) References Cited

U.S. PATENT DOCUMENTS

| | | | | |
|---|---|---|---|---|
| 5,987,935 | A | 11/1999 | Uhlin | |
| 6,675,496 | B1 | 1/2004 | Moon et al. | |
| 7,007,955 | B2 | 3/2006 | Cross et al. | |
| 7,627,960 | B2 | 12/2009 | Beyerle et al. | |
| 7,836,607 | B2 * | 11/2010 | Kim | D06F 58/04 165/158 |
| 7,992,322 | B2 | 8/2011 | Kim | |
| 8,028,439 | B2 * | 10/2011 | Prajescu | F16J 15/061 165/89 |
| 8,069,582 | B2 | 12/2011 | Lee et al. | |
| 8,127,464 | B2 | 3/2012 | Schone | |
| 8,220,983 | B2 | 7/2012 | Altounian | |
| 8,499,473 | B2 | 8/2013 | Dal Ben et al. | |
| 8,539,694 | B2 | 9/2013 | Moon et al. | |
| 8,875,416 | B2 | 11/2014 | Anderson et al. | |
| 9,580,856 | B1 * | 2/2017 | Schurr | D06F 58/04 |
| 2004/0159010 | A1 | 8/2004 | Hwang | |
| 2007/0044342 | A1 | 3/2007 | Burns et al. | |
| 2007/0074419 | A1 | 4/2007 | Starrett | |
| 2010/0000022 | A1 | 1/2010 | Hendrickson et al. | |
| 2014/0327212 | A1 | 11/2014 | Lowe et al. | |
| 2016/0187062 | A1 | 6/2016 | Lowe | |
| 2017/0130388 | A1 * | 5/2017 | Schurr | D06F 58/04 |
| 2017/0276250 | A1 * | 9/2017 | Lowe | D06F 58/04 |

FOREIGN PATENT DOCUMENTS

| | | | |
|---|---|---|---|
| GB | 1454135 | A | 10/1976 |
| GB | 2067601 | A | 7/1981 |
| GB | 2297588 | A | 8/1996 |
| WO | 2012068646 | A1 | 5/2012 |

* cited by examiner

CLOTHES DRYER WITH A DRUM SEAL

CROSS-REFERENCE TO RELATED APPLICATIONS

This application is a continuation of U.S. patent application Ser. No. 14/821,842, filed Aug. 10, 2015, now U.S. Pat. No. 9,580,856, issued Feb. 28, 2017, which is incorporated herein by reference in its entirety.

BACKGROUND

Contemporary laundry treating appliances include clothes dryers that utilize a heating element, such as a gas or electric heater or a heat pump, to heat air forced through the clothes dryer to dry a load of washed clothes. Contemporary laundry treating appliances can also include condensing dryers. Traditionally, clothes dryers can include a cylindrical drum held between opposing bulkheads with a felt seal along the interface between the drum and to bulkheads to retain the heated air during the drying cycle. The loss of heated air through the interface can negatively impact the drying time and lead to resource waste.

BRIEF DESCRIPTION OF THE INVENTION

In one embodiment, the invention relates to a clothes dryer comprising a front bulkhead having a door opening, a rear bulkhead, a drum comprising a cylindrical wall terminating in a front edge proximate the front bulkhead and a rear edge proximate the rear bulkhead, with a least one of the front and rear edges having a lip, a seal attached to the lip and having discontinuous body defining a gap, and a variable shape spacer located within the intervening gap.

In another embodiment, the invention relates to a clothes dryer comprising a front bulkhead having a door opening, a rear bulkhead, a drum comprising a cylindrical wall terminating in a front edge proximate the front bulkhead and a rear edge proximate the rear bulkhead, with a least one of the front and rear edges having a lip, a seal attached to the lip and having a discontinuous body defining a gap and made from thermally expanding material, and a thermally-responsive, spacer located within the intervening gap.

DESCRIPTION OF EMBODIMENTS OF THE INVENTION

Figure 1:
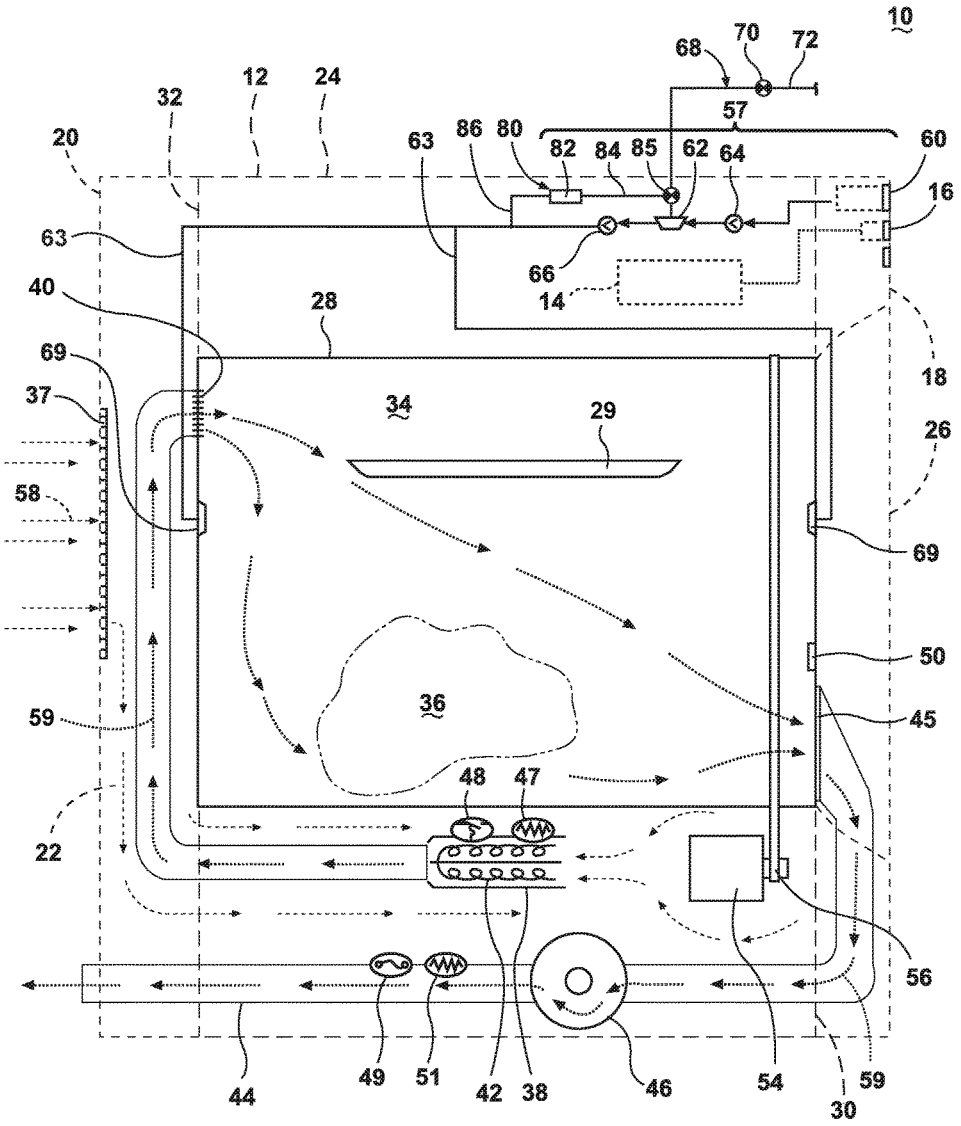
FIG. 1 is a schematic view of a clothes dryer.

FIG. 1 is a schematic view of a household appliance in the form of a clothes dryer 10 according to a first embodiment. The clothes dryer 10 of the illustrated embodiment may include a cabinet 12 defined by a front wall 18, a rear wall 20, and a pair of side walls 22 and 28 supporting a top wall 24. A door 26 may be hingedly mounted to the front wall 18 and may be selectively moveable between opened and closed positions to close an opening in the front wall 18, which provides access to the interior of the cabinet. A control panel or user interface 16 may include one or more knobs, switches, displays, and the like for communicating with the user, such as to receive input and provide output.

The laundry treating appliance of FIG. 1 illustrated as a clothes dryer 10 is described and shown for illustrative purposes and is not intended to be limiting. The methods described herein may be used with any suitable laundry treating appliance and are not limited to use with clothes dryers. The laundry treating appliance may be any machine that treats fabrics, and examples of the laundry treating appliance may include, but are not limited to, a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing/revitalizing machine; an extractor; a non-aqueous washing apparatus; and a revitalizing machine. For illustrative purposes, the laundry treating appliance and a method will be described with respect to a clothes dryer with the fabric being a laundry load, with it being understood that the invention may be adapted for use with other types of laundry treating appliance for treating fabric. Examples of laundry include, but are not limited to, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be dried in the clothes dryer 10.

A rotatable drum 28 comprising a cylindrical wall terminating in a front edge and rear edge may be disposed within the interior of the cabinet 12 between opposing stationary rear and front bulkheads 30 and 32, which collectively define a drying chamber 34, for drying laundry. Alternatively, the drum 28 and bulkheads configuration may be of a different type, some non-limiting examples are: a closed end drum (for example, closed rear end), a non-stationary rear bulkhead or a non-stationary inlet grill type.

The front bulkhead 30 may have an opening that aligns with the open face of the front wall 18. The drum 28 may have a circumference larger than that of the door 26 such that part of the front bulkhead 30 covers a portion of the front face of the drum 28. Thus, when the door 26 may be in a closed position, it closes the face of the cabinet 12 and not the entire face of the drum 28. However, the drum 28 may be considered to be closed when the door 26 is in the closed position.

The drum 28 may further optionally have one or more lifters or baffles 29. In most dryers, there are multiple baffles. The baffles 29 may be located along the inner surface of the drum 28 defining an interior circumference of the drum 28 and may be oriented generally parallel to a rotational axis of the drum 28. The baffles 29 facilitate the tumbling action of the fabric load within the drum 28 as the drum 28 rotates about the rotational axis. Alternatively, a textured surface may be used in place of or in addition to the baffles 29.

An air flow system may be of any conventional type and is provided to draw air into and exhaust air from the treating chamber 34. As illustrated, the air flow system has a supply conduit 38 coupled to the treating chamber 34 by an inlet 40 in the rear bulkhead 32 and an exhaust conduit 44 coupled to the treating chamber 34 by a lint filter 45. A blower 46 is provided to first draw air through the inlet duct, into the heating chamber, and exhausting air from the heating chamber through the outlet duct. A heating element 42 may be provided within the inlet duct to heat the air as it passes through on the way to the treating chamber 34.

A motor 54 may be coupled to the drum 28 through a belt 56 (or any other means for indirect drive such as a gearbox) and a drive shaft may rotate the drum 28. Some non-limiting examples of indirect drive are: three-phase induction motor drives, various types of single phase induction motors such as a permanent split capacitor (PSC), a shaded pole and a split-phase motor. Alternately, the motor 54 may be a direct drive motor, as is known in the art. Some non-limiting examples of an applicable direct drive motor are: a brushless permanent magnet (BPM or BLDC) motor, an induction motor, etc.

A dispensing system 57 may be provided to the clothes dryer 10 to dispense one or more treating chemistries to the treating chamber 34 according to a cycle of operation. As illustrated, the dispensing system 57 may be located in the interior of the cabinet 12 although other locations are also possible. The dispensing system 57 may be fluidly coupled to a water supply 68. The dispensing system 57 may be further coupled to the treating chamber 34 through one or more nozzles 69. As illustrated, nozzles 69 are provided to the front and rear of the treating chamber 34 to provide the treating chemistry or liquid to the interior of the treating chamber 34, although other configurations are also possible.

As illustrated, the dispensing system 57 may include a reservoir 60, which may be a cartridge, for a treating chemistry that is releasably coupled to the dispensing system 57, which dispenses the treating chemistry from the reservoir 60 to the treating chamber 34. The reservoir 60 may include one or more cartridges configured to store one or more treating chemistries in the interior of cartridges. A suitable cartridge system may be found in U.S. Pub. No. 2010/0000022 to Hendrickson et al., filed Jul. 1, 2008, now U.S. Pat. No. 8,196,441, issued Jun. 12, 2012, entitled "Household Cleaning Appliance with a Dispensing System Operable Between a Single Use Dispensing System and a Bulk Dispensing System," which is herein incorporated by reference in its entirety.

A mixing chamber 62 may be provided to couple the reservoir 60 to the treating chamber 34 through a supply conduit 63. Pumps such as a metering pump 64 and delivery pump 66 may be provided to the dispensing system 57 to selectively supply a treating chemistry and/or liquid to the treating chamber 34 according to a cycle of operation. The water supply 68 may be fluidly coupled to the mixing chamber 62 to provide water from the water source to the mixing chamber 62. The water supply 68 may include an inlet valve 70 and a water supply conduit 72. It is noted that, instead of water, a different treating chemistry may be provided from the exterior of the clothes dryer 10 to the mixing chamber 62.

The treating chemistry may be any type of aid for treating laundry, non-limiting examples of which include, but are not limited to, water, fabric softeners, sanitizing agents, de-wrinkling or anti-wrinkling agents, and chemicals for imparting desired properties to the laundry, including stain resistance, fragrance (e.g., perfumes), insect repellency, and UV protection.

The dryer 10 may also be provided with a steam generating system 80 which may be separate from the dispensing system 57 or integrated with portions of the dispensing system 57 for dispensing steam and/or liquid to the treating chamber 34 according to a cycle of operation. The steam generating system 80 may include a steam generator 82 fluidly coupled with the water supply 68 through a steam inlet conduit 84. A fluid control valve 85 may be used to control the flow of water from the water supply conduit 72 between the steam generating system 80 and the dispensing system 57. The steam generator 82 may further be fluidly coupled with the one or more supply conduits 63 through a steam supply conduit 86 to deliver steam to the treating chamber 34 through the nozzles 69. Alternatively, the steam generator 82 may be coupled with the treating chamber 34 through one or more conduits and nozzles independently of the dispensing system 57.

The steam generator 82 may be any type of device that converts the supplied liquid to steam. For example, the steam generator 82 may be a tank-type steam generator that stores a volume of liquid and heats the volume of liquid to convert the liquid to steam. Alternatively, the steam generator 82 may be an in-line steam generator that converts the liquid to steam as the liquid flows through the steam generator 82.

It will be understood that any suitable dispensing system and/or steam generating system may be used with the dryer 10. It is also within the scope of the invention for the dryer 10 to not include a dispensing system or a steam generating system.

Figure 2:
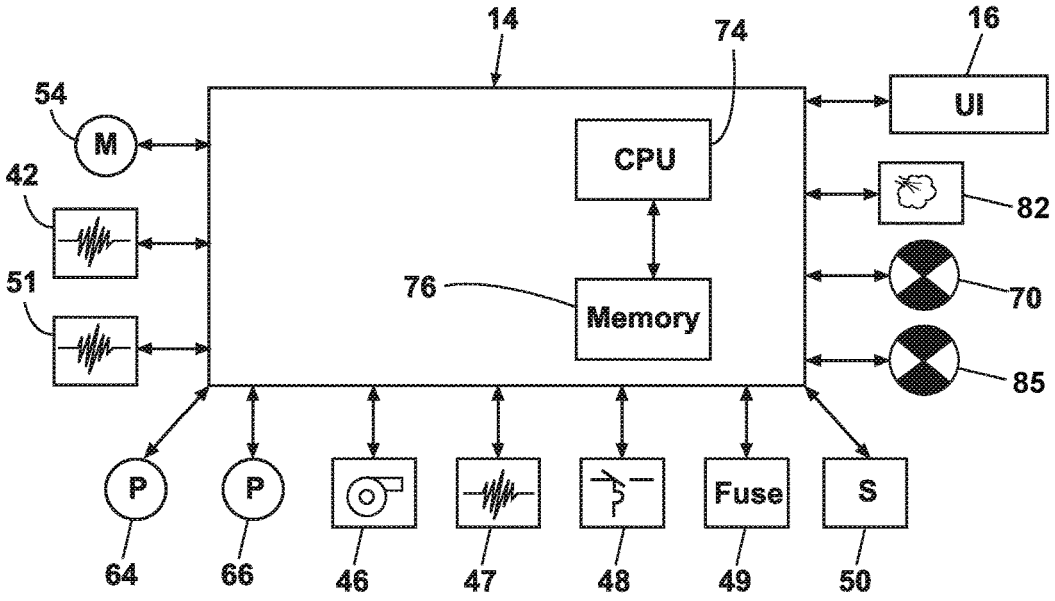
FIG. 2 is a schematic of a control system for the dryer of FIG. 1.

Referring now to FIG. 2, which is a schematic view of the controller 14 coupled to the various components of the dryer 10. The controller 14 may be communicably coupled to components of the clothes dryer 10 such as the heating element 42, blower 46, thermistor 47, thermostat 48, thermal fuse 49, thermistor 51, moisture sensor 50, motor 54, inlet valve 70, pumps 64, 66, steam generator 82 and fluid control valve 85 to either control these components and/or receive their input for use in controlling the components. The controller 14 is also operably coupled to the user interface 16 to receive input from the user through the user interface 16 for the implementation of the drying cycle and provide the user with information regarding the drying cycle.

The user interface 16 may be provided having operational controls such as dials, lights, knobs, levers, buttons, switches, and displays enabling the user to input commands to a controller 14 and receive information about a treatment cycle from components in the clothes dryer 10 or via input by the user through the user interface 16. The user may enter many different types of information, including, without limitation, cycle selection and cycle parameters, such as cycle options. Any suitable cycle may be used. Non-limiting examples include: Casual, Delicate, Super Delicate, Heavy Duty, Normal Dry, Damp Dry, Sanitize, Quick Dry, Timed Dry, and Jeans.

The controller 14 may implement a treatment cycle selected by the user according to any options selected by the user and provide related information to the user. The controller 14 may also comprise a central processing unit (CPU) 74 and an associated memory 76 where various treatment cycles and associated data, such as look-up tables, may be stored. One or more software applications, such as an arrangement of executable commands/instructions may be stored in the memory and executed by the CPU 74 to implement the one or more treatment cycles.

In general, the controller 14 will effect a cycle of operation to effect a treating of the laundry in the treating chamber 34, which may or may not include drying. The controller 14 may actuate the blower 46 to draw an inlet air flow 58 into the supply conduit 38 through the rear vent 37 when air flow is needed for a selected treating cycle. The controller 14 may activate the heating element 42 to heat the inlet air flow 58 as it passes over the heating element 42, with the heated air 59 being supplied to the treating chamber 34. The heated air 59 may be in contact with a laundry load 36 as it passes through the treating chamber 34 on its way to the exhaust conduit 44 to effect a moisture removal of the laundry. The heated air 59 may exit the treating chamber 34, and flow through the blower 46 and the exhaust conduit 44 to the outside of the clothes dryer 10. The controller 14 continues the cycle of operation until completed. If the cycle of operation includes drying, the controller 14 determines when the laundry is dry. The determination of a "dry" load may be made in different ways, but is often based on the moisture content of the laundry, which is typically set by the user based on the selected cycle, an option to the selected cycle, or a user-defined preference.

Figure 3:
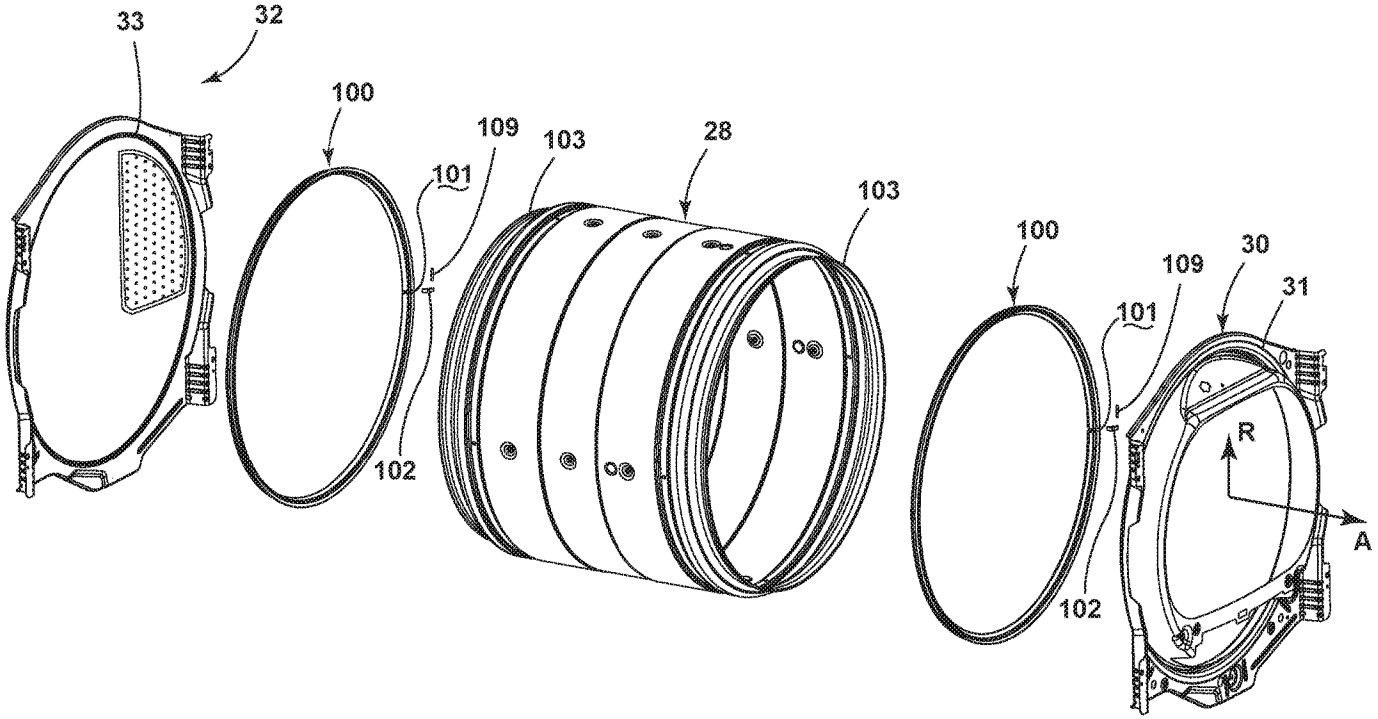
FIG. 3 is an exploded view of a front bulkhead, front seal, dryer drum, rear seal, and rear bulkhead for the household appliance of FIG. 1.

FIG. 3 is an exploded view of the clothes dryer 10 including the front bulkhead 30, a front seal 100, the dryer drum 28, a rear seal 100, and the rear bulkhead 32 respectively. A half channel 31, 33 is formed in each of the front and rear bulkheads 30, 32, respectively. The dryer drum 28 terminates in opposing front and rear lips 103 to which the seals 100 are mounted, such as in an interference fit, like a slide-on, press-fit or snap-fit connection. The lip 103 within the seal 100 is then correspondingly received within the half channels 31, where the seal 100 abuts the corresponding bulkhead 32 to seal the drum 28 relative to the bulkhead 32. The seals 100, as illustrated, do not form a continuous loop and terminate in opposing ends having a confronting relationship with each other which leaves an intervening gap 101. A spacer 102 is located within the gap 101.

The seals 100 do not form a complete loop because the seals 100 are made from a material that thermally expands/contracts. Depending on the size of the clothes dryer 10, the seals 100 may have a length of 6 to 8 feet, which can lead to a length extension of up to 1 inch when the seal thermally expands under the temperatures encountered in the clothes dryer 10. This amount of thermal expansion renders impractical a continuous loop configuration for the thermal seals 100. Thus, a linear configuration is contemplated for the seals 100, with the spacer 102 filling in the gap between the ends. A coupler, illustrated in one example as a pin 109, is provided to couple the opposing ends of the seal 100 and provide a support for mounting the spacer 102.

Figure 4:
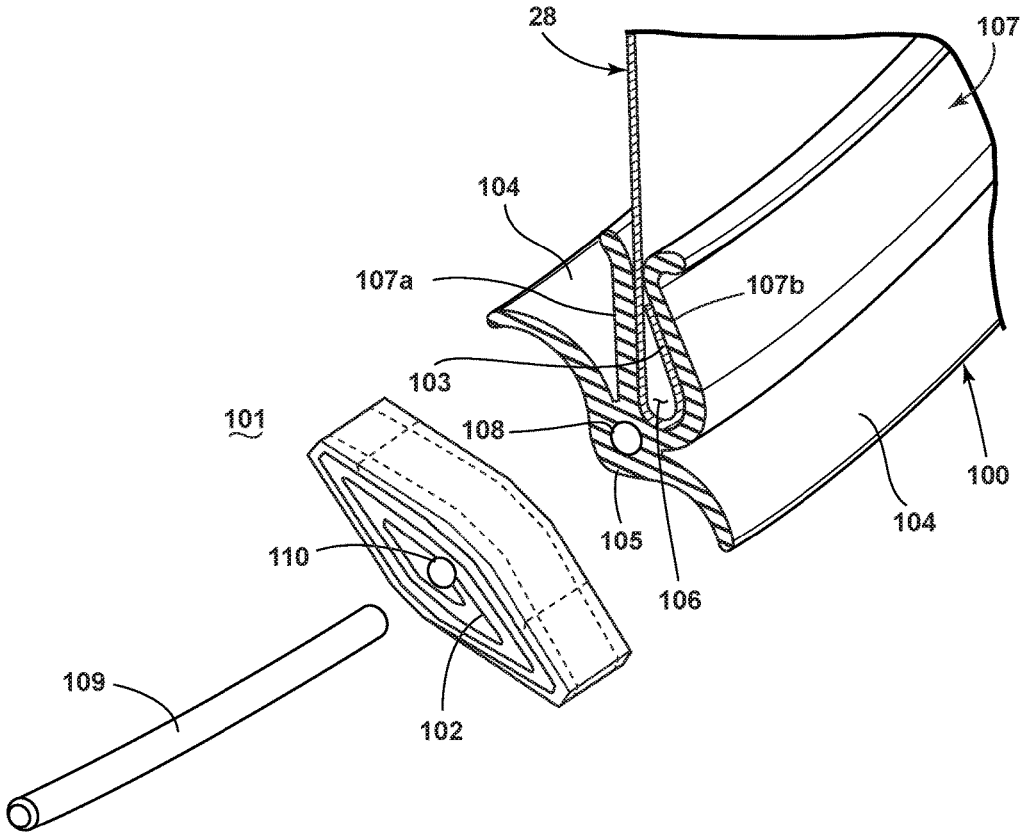
FIG. 4 is an exploded view of a partial and enlarged cross section of the dryer drum and bulkhead with a profile of the seal shown in place including the connector pin which spans the gap created when the seal is in place and the spacer that the pin holds in place to fill the gap.

Referring to FIG. 4, the details of the seal 100, spacer 102 and pin 109 is better illustrated in the context of one of the opposing ends of the seal. The seal 100 comprises a body 105 in which is formed an aperture 108. The seal 100 includes an attachment 107 in the form of fingers 107*a*, 107*b* extending from the body 105 and defining an intervening recess 106, which is sized to match the profile of the lip 103. The fingers 107*a*, 107*b*, are shaped such that they have to be deflected when the lip 103 is received within the annular recess 106 resulting in a compression force between fingers 107*a* and 107*b*. In the particular embodiment, since the lip 103 is enlarged near the tip, the addition of the compression force will aid in retaining the seal 100 to the lip 103.

The seal 100 further includes flexible wings 104 which extend out from the body 105, which are used to form a seal relative to the corresponding bulkhead 30, 32. While two wings 104 are illustrated, fewer or more wings can be used. The wings 104 can be arranged such that they form an axial and/or radial seal between the corresponding pairs of bulkhead 30, 32 and lip 103.

The spacer 102 has a passageway 110, which is sized to receive the pin 109. The spacer 102 can have any variable shape that allows for the filling of the gap 101 in response to the changing size of the space 101 caused by the thermal expansion/contraction of the seal 100. As illustrated, the spacer 102 is made from a sheet of folded material, folded on itself and sewn or in an accordion fold, that provides the spacer with the ability to vary its shape in response to a change in the gap 101. In the folded-body configuration, the spacer 102 can be made out of felt or any other material capable of being folded.

The pin 109 is sized to be received within the apertures 108 of the opposing ends of the seal 100 and passing through the passageway 110 of the spacer. The pin 109 can be made of steel, plastic, or any suitable material capable of being bent to follow the same radius as the dryer drum 28. The pin 109 only needs to be long enough to span the gap 101 formed when the seal 100 terminates in opposing ends while remaining fixed in the apertures 108. The relationship between the pin 109, the apertures 108, and passageway 110 is such that the pin does not deleteriously interfere with the thermal expansion/contraction of the seal 100 or the changing of shape of the spacer 102.

Figure 5:
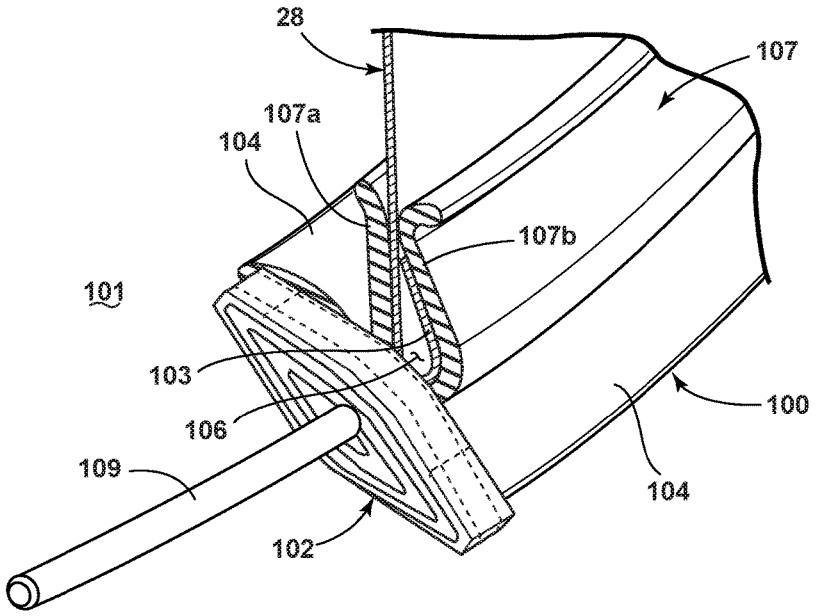
FIG. 5 is a partial and enlarged cross section of the dryer drum and bulkhead with a profile of the seal, connector pin, and spacer shown assembled.

FIG. 5 is an assembled view of the coupler, as a pin 109, holding the spacer 102, along with the seal 100 mounted to the lip 103. The pin 109 spans the gap 101 by coupling one end of the seal 100 to the opposing end. While not shown in FIG. 5, the other opposing end is a mirror image of the opposing end that is shown and includes a corresponding aperture 108 in which the pin 109 is received.

When assembled, the spacer 102 is provided between the opposing ends of the seal 100 and is mounted to the pin 109. The pin 109 slides through the passageway 110 of the spacer 102 and is fixed in the aperture 108 of the seal 100 so that the pin 109 holds the spacer 102 in place between the opposing ends of the seal 100.

To install the seal 100, a person or machine presses the seal 100 over the lip 103 such that the recess 106 of the attachment 107 receives the lip 103, with the fingers 107*a*, 107*b* applying a compression force to the lip 103 to aid in retaining the seal 100 to the lip 103.

The spacer 102 and pin 109 can be mounted to the seal before or after the seal 100 is mounted to the lip lip 103. In either case, the pin 109 is inserted into the apertures 108 of the opposing ends of the seal 100 and inserted through the passageway 110 of the spacer 102. The spacer 102 can be mounted to the pin 109 before either end of the pin 109 is inserted into the aperture 108 of the seal 100 or after one end of the pin 109 is inserted into one of the apertures 108. For ease of final assembly, it is contemplated that the spacer 102 and pin 109 will be mounted to the seal 100 prior to the mounting of the seal 100 to the lip 103.

Figure 6:
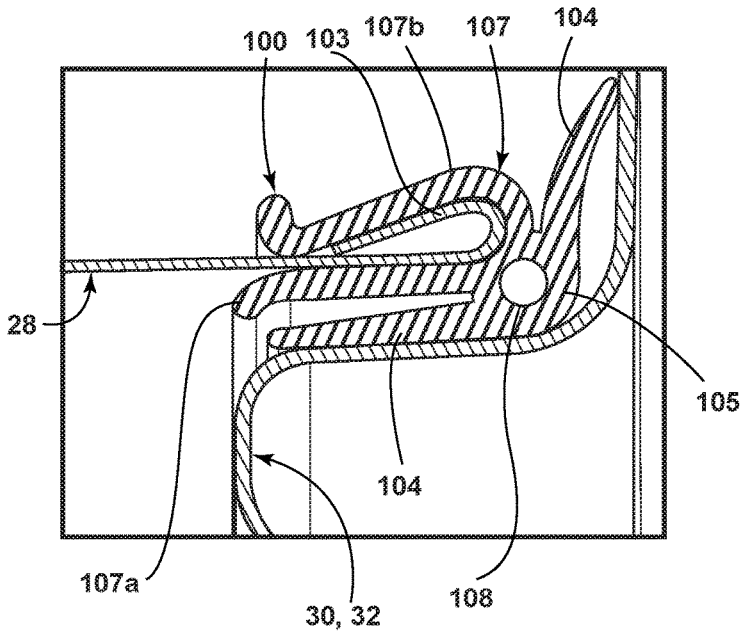
FIG. 6 is a first orientation of the seal with the flexible wings pinched against the bulkhead in the radial direction.

The general sealing function of the seal 100 will now be described with respect to FIGS. 6 and 7. In the expected environment for the seal 100, the drum 28 and bulkheads 30, 32 are known to have some relative movement or "play", which can lead to a relative shift in the position of the drum 28 to one or more of the bulkheads 30, 32. A common scenario where such a shift can occur is during the initial rotation of the drum 28 with a wet clothes load. When the clothes are wet, the clothes load has its greatest mass, which, alone, is sufficient to cause the drum 28 to move both radially along axis R (see FIG. 3) and axially along axis A (see FIG. 3). During drying, the drum 28 is rotated while heated air is passed through the drum 28 to tumble dry the clothes load. The tumbling of the clothes load results in a repeated release and application of a force on the drum 28, which can also relatively move the drum 28 radially and axially relative to the bulkhead 30, 32.

The seal 100 can accommodate the relative movement of the drum 28 and the bulkhead 30, 32 through flexible wings 104, which are configured and shaped in such a way that they can flex to accommodate the relative change in position of the drum 28 and bulkhead 30, 32.

Figure 7:
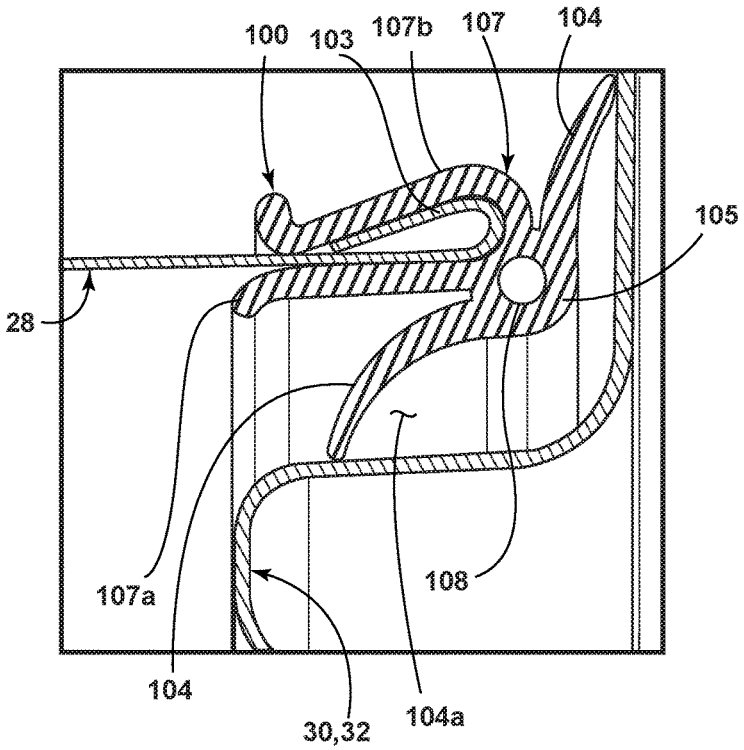
FIG. 7 is a second orientation of the seal with the flexible wings shown extended and still abutting up against the bulkhead in the radial direction.

FIG. 7 illustrates a scenario where the drum 28 is radially shifted toward the bulkhead 30, 32. In this position, one of the wings 104 forming the radial seal in a pinched, flexed position while still maintaining a continuous seal along the bulkhead 30, 32.

FIG. 8 illustrates a scenario wherein the drum 28 is radially shifted away from the bulkhead 30, 32 and the same radial wing from FIG. 7 is in an extended, more relaxed position, while still maintaining a continuous seal along the bulkhead 30, 32.

FIGS. 7 and 8 together illustrate how with movement of the drum 28, the wings 104 are allowed to flex and extend while still maintaining a continuous seal along the bulkhead 30, 32. The seal is also allowed to slide along the bulkhead 30, 32 shown in that side 104*a* is not visible in FIG. 7 but becomes visible in FIG. 8 due to sliding.

Furthermore the axial and radial movement which causes sliding is facilitated by a low friction surface along the wing side 104*a* which is in contact with the bulkhead 30, 32 allowing the seal 100 to slide with the movement and shifting of the drum 28. The seal 100 can be coated with a low friction surface along the side 104*a* or it can be co-extruded during production to include two different materials, one being a low friction surface for the side in contact with the bulkhead 30, 32.

Benefits of this invention will now be described which include ease of assembly and reduced airflow loss. While the prior art comprises seals made entirely of felt, requiring an adhesive such as glue to install them, the extruded drum seal 100 is easily placed due to its design in which the annular recess of the seal is molded to receive the lip of the drum 28. When in place pressure variations in the drum cause the wings of the extruded drum seal 100 to self-seal which reduces the airflow loss compared to the prior art. The prior art felt seals can lose up to 30% of the airflow within the dryer drum 28 due to their inefficient sealing technology while the extruded drum seal 100 of the invention allows only 3% loss through the small spacer. Since the present invention is easier to assemble and reduces airflow losses, it also saves consumers in energy costs and contributes to shorter drying times.

While the invention has been specifically described in connection with certain specific embodiments thereof, it is to be understood that this is by way of illustration and not of limitation, and the scope of the appended claims should be construed as broadly as the prior art will permit.

What is claimed is:

1. A clothes dryer comprising:

a front bulkhead having a door opening;

a rear bulkhead;

a drum comprising a cylindrical wall terminating in a front edge proximate the front bulkhead and a rear edge proximate the rear bulkhead, with at least one of the front and rear edges having a lip;

a seal attached to the lip and having a discontinuous body defining an intervening gap; and a variable shape spacer located within the intervening gap.

2. The clothes dryer of claim 1 wherein the variable shape spacer is thermally responsive and varies in shape in response to temperature changes.

3. The clothes dryer of claim 2 wherein the discontinuous body is made of thermally expanding material and the intervening gap varies in shape depending on a thermal expansion of the body.

4. The clothes dryer of claim 3 wherein the spacer varies in shape in response to the intervening gap varying to fill the intervening gap.

5. The clothes dryer of claim 1 wherein the discontinuous body is made of plastic.

6. The clothes dryer of claim 1 wherein the discontinuous body comprises opposing spaced ends and the variable shape spacer comprises a coupler spanning between the ends.

7. The clothes dryer of claim 6 wherein the variable shape spacer comprises a felt element mounted to the coupler.

8. The clothes dryer of claim 6 wherein the opposing ends comprise corresponding apertures and the coupler comprises a pin received within the apertures.

9. The clothes dryer of claim 1 wherein the seal further comprises at least one wing extending from the body and abutting a corresponding front or rear bulkhead.

10. The clothes dryer of claim 9 wherein the at least one wing forms at least one of an axial seal or radial seal with the corresponding front or rear bulkhead.

11. The clothes dryer of claim 10 wherein the at least one wing comprises two wings, with one of the two wings forming the axial seal and an another of the two wings forming the radial seal.

12. The clothes dryer of claim 9 wherein the at least one wing comprises a low friction surface abutting the corresponding front or rear bulkhead.

13. A clothes dryer comprising:

a front bulkhead having a door opening;

a rear bulkhead;

a drum comprising a cylindrical wall terminating in a front edge proximate the front bulkhead and a rear edge proximate the rear bulkhead, with least one of the front and rear edges having a lip;

a seal attached to the lip and having a discontinuous body defining an intervening gap and made from thermally expanding material; and a thermally-responsive spacer located within the intervening gap.

14. The clothes dryer of claim 13 wherein the spacer varies in shape in response to temperature changes.

15. The clothes dryer of claim 13 wherein the discontinuous body is made of thermally expanding material and the intervening gap varies in shape depending on a thermal expansion of the body.

16. The clothes dryer of claim 15 wherein the spacer varies in shape in response to the intervening gap varying to fill the intervening gap.

17. The clothes dryer of claim 13 wherein the discontinuous body is made of plastic.

18. The clothes dryer of claim 13 wherein the discontinuous body comprises opposing spaced ends and the thermally-responsive spacer comprises a coupler extending between the ends.

19. The clothes dryer of claim 18 wherein the thermally-responsive spacer comprises a felt element mounted to the coupler.

20. The clothes dryer of claim 18 wherein the spaced ends comprise corresponding apertures and the coupler comprises a pin received within the apertures.

21. The clothes dryer of claim 13 wherein the seal further comprises at least one wing extending from the body and abutting a corresponding front or rear bulkhead.

22. The clothes dryer of claim 21 wherein the at least one wing forms at least one of an axial seal or radial seal with the corresponding front or rear bulkhead.

23. The clothes dryer of claim 22 wherein the at least one wing comprises two wings, with one of the two wings forming the axial seal and an another of the two wings forming the radial seal.

24. The clothes dryer of claim 21 wherein the at least one wing comprises a low friction surface abutting the corresponding front of roar bulkhead.

* * * * *